United States Patent [19]

Rogers et al.

[11] 4,083,753

[45] Apr. 11, 1978

[54] ONE-SPOT COKE QUENCHER CAR

[75] Inventors: Robert C. Rogers, Pittsburgh; John D. Sustarsic, McKees Rocks, both of Pa.

[73] Assignee: Koppers Company, Inc., Pittsburgh, Pa.

[21] Appl. No.: 683,057

[22] Filed: May 4, 1976

[51] Int. Cl.[2] ..... C10B 39/14

[52] U.S. Cl. ..... 202/227; 105/235; 105/257; 105/422; 202/263; 214/10

[58] Field of Search ..... 202/227, 262, 263; 105/235, 257, 422; 298/1 B, 8 R; 214/10

[56] References Cited

U.S. PATENT DOCUMENTS

| | | | |
|---|---|---|---|
| 425,797 | 4/1890 | Hunt | 202/227 |
| 2,232,116 | 2/1941 | Koppers | 105/257 X |
| 3,959,083 | 5/1976 | Goedde et al. | 202/227 X |
| 3,984,289 | 10/1976 | Sustarsic et al. | 202/262 |
| 3,988,211 | 10/1976 | Lewandowski et al. | 202/227 |

*Primary Examiner*—Barry S. Richman
*Assistant Examiner*—Arnold Turk
*Attorney, Agent, or Firm*—R. Lawrence Sahr; Oscar B. Brumback

[57] ABSTRACT

A coke quencher car has a movable bed within a hopper that receives hot coke when pushed from a coke oven chamber. The movable bed is first elevated and then lowered to a horizontal position as coke falls into the hopper to more evenly distribute the coke therein. The bed may in some instances be fixed at an angle to the horizontal and in some instances the bed may be articulated and comprise a plurality of sections.

11 Claims, 8 Drawing Figures

ONE-SPOT COKE QUENCHER CAR

BACKGROUND OF THE INVENTION

The present invention relates generally to apparatus for receiving hot coke pushed from a horizontal coke oven chamber, and, more particularly, to an improved one-spot coke quencher car.

In the operation of a conventional coke oven battery comprising numerous coking chambers, it is customary to "push" coke from the chambers on a regular schedule. The hot coke is pushed by a machine carrying a ram that is designed especially for pushing the coke out of the oven chamber, through a coke guide and into a coke quencher car. The coke guide is designed to channel the hot coke into a fume collecting hood over a coke quencher car that is ready to receive the hot coke pushed from the oven chamber.

Heretofore, it has been customary to so place the quencher car that the hot coke gravitates into one end portion of the car. Then, as the coke continues to gravitate into the car, it is moved on rails by a locomotive so that the coke is more or less evenly distributed in the car.

Thereafter, the car with the hot coke therein is moved by the locomotive to a remote coke quenching station and water sprayed onto the hot coke quenches it and cools it. After quenching, the coke is dumped onto a coke wharf, and the quencher car returns to the coke oven battery and is ready to receive another load of hot coke from another coke oven chamber.

Heretofore, in the prior art, there is one U.S. Pat. 3,868,309 that illustrates and describes a one-spot coke quenching car. The car of this patent has a large hopper that receives hot coke pushed from an oven chamber through a hood fixed to the top of the car; the hood sloping upwardly and being fitted with a flexible wire cloth screen or curtain that can be stretched over the hood after the entire mass of hot coke has gravitated into the hopper. Coke discharges from the car through bottom pivotable doors.

The patent also discloses a transfer car that is coupled to the quencher car and that carries gas scrubbing equipment.

SUMMARY OF THE INVENTION

A coke quencher car has a tiltable hopper, wherein hot coke pushed from a coke oven chamber is received, and an extendable and retractable covering over the hopper. A movable articulate bed is disposed in the hopper and means is provided for moving the bed sections to an angular position with respect to a horizontal plane, the means also lowers the movable bed sections to a horizontal plane as coke gravitates into the hopper. Means is provided for tilting the hopper and coke discharges therefrom through openings in the hopper side wall onto a coke wharf.

For a further understanding of the invention and for features and advantages thereof, reference may be made to the following description and the drawings which illustrate a preferred embodiment of equipment in accordance with the invention.

DETAILED DESCRIPTION

Figures 1, 4:
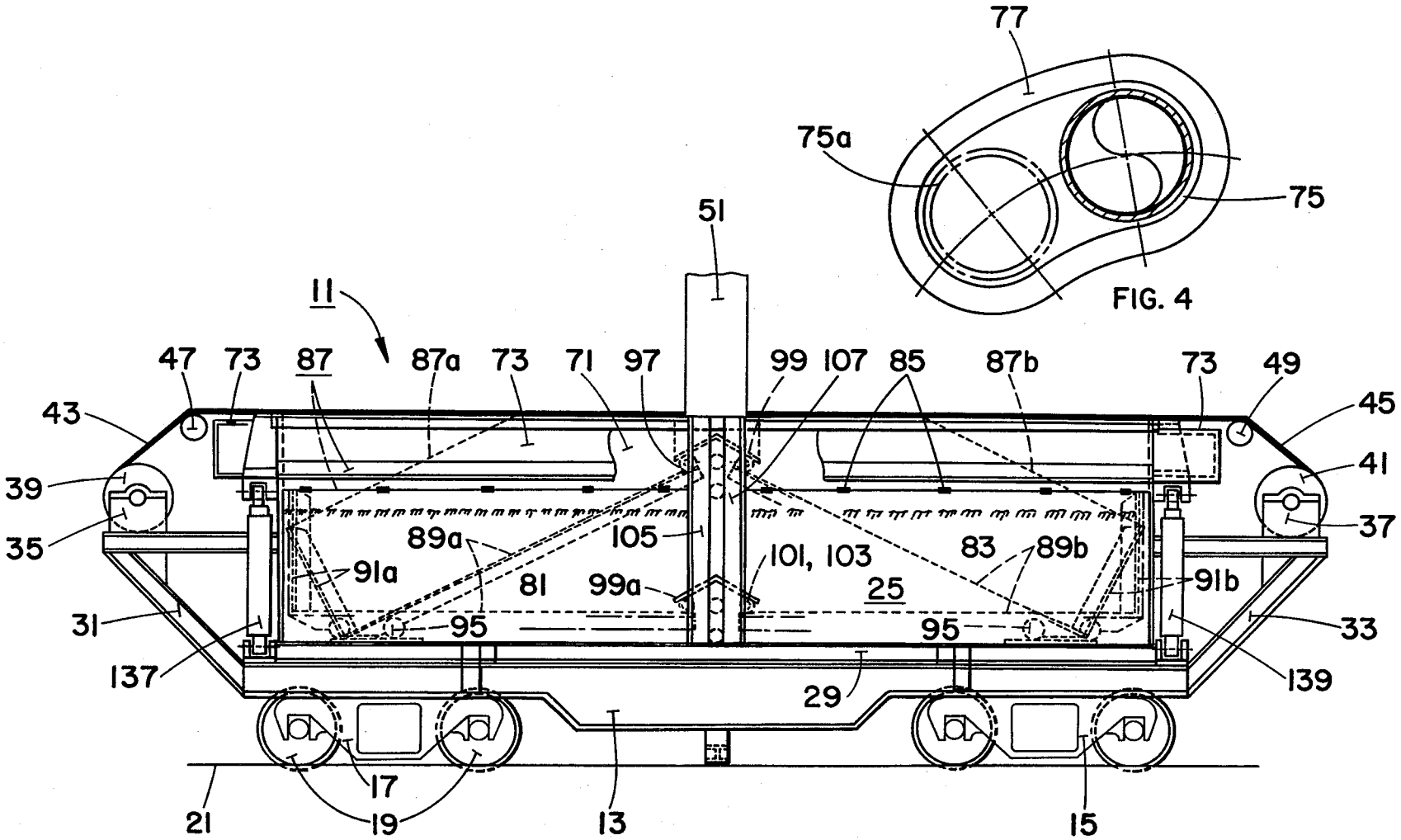
FIG. 1 is a schematic side elevational view of one embodiment of the invention.
FIG. 4 is a view along line IV—IV of FIG. 2.
Figure 2:
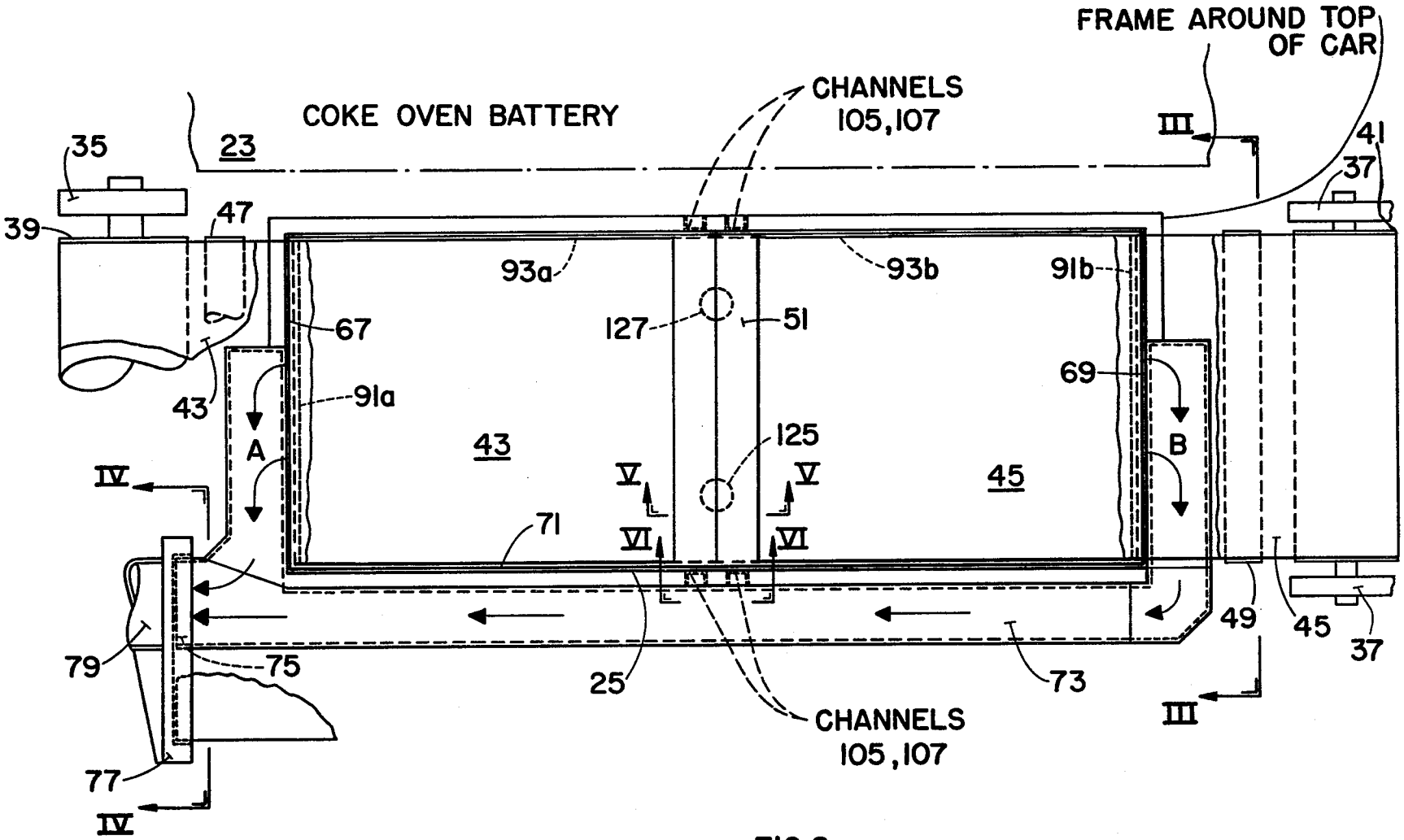
FIG. 2 is a plan view of the embodiment of the invention shown in FIG. 1.
Figure 3:
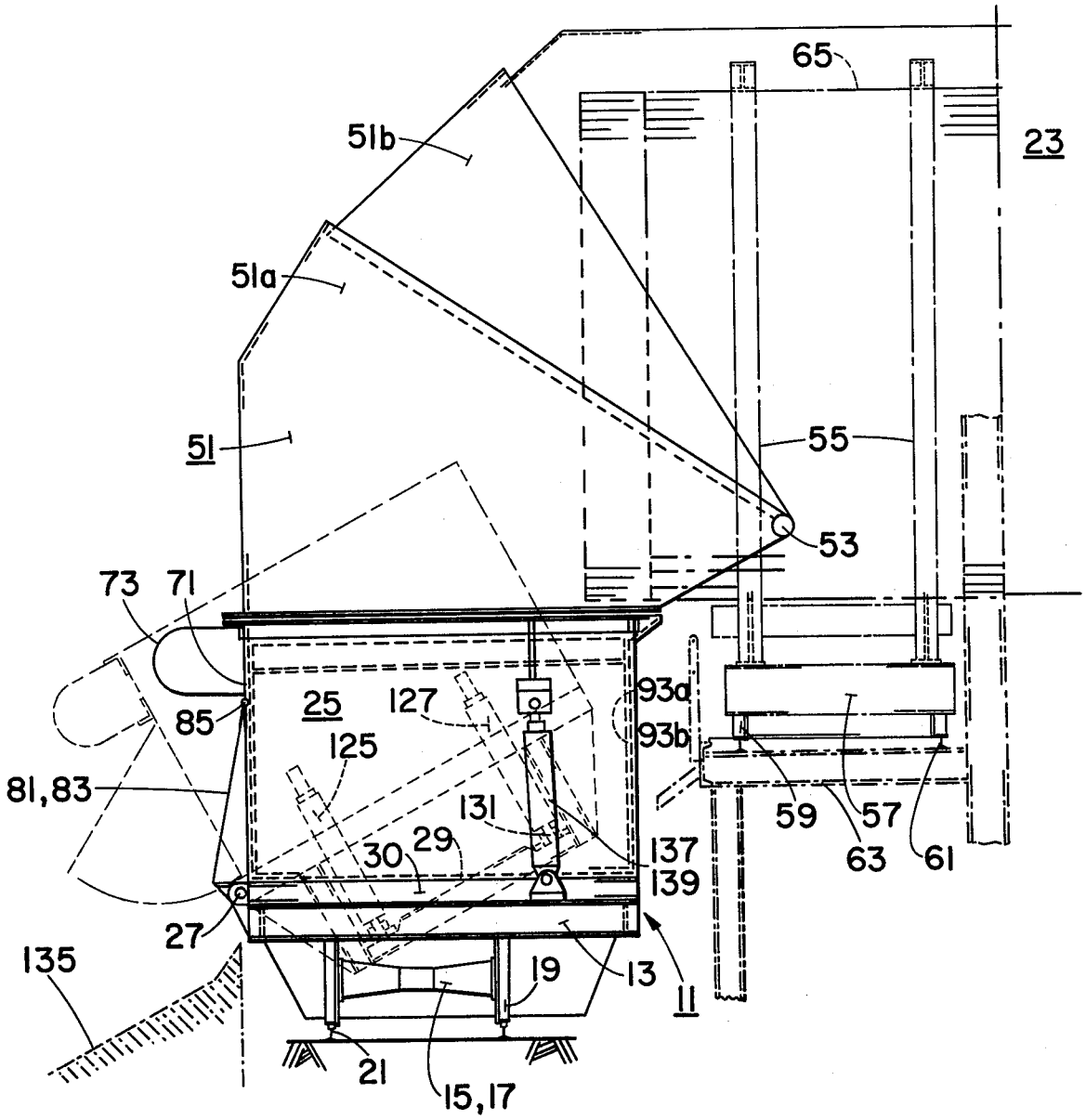
FIG. 3 is a view along line III—III of FIG. 2.

Referring to FIG. 1, a coke quencher car 11 in accordance with the invention comprises a frame portion 13 that is mounted to conventional front 15 and rear 17 trucks having wheels 19 coacting with rails 21 that extend along one side of a coke oven battery 23 (FIGS. 2, 3).

As shown in FIG. 3, a hopper 25 for receiving and transporting hot coke is pivotally mounted, as at 27, to the frame 13. The hopper 25 is generally rectangular in shape and has a flat bottom 29 and an open top. The flat bottom is supported on a movable frame 30 that pivots with the hopper 25.

Mounted to the frame 13 at each end thereof is a support 31, 33 that carries a pair of bearings 35, 37 in which a cylinder 39, 41 is journaled. The cylinders 39, 41 each carry a flexible screen or curtain 43, 45. One type of screen or curtain material which has been found to be satisfactory and is preferred is made and sold by Audubon Metalwove Belt Corp. of Philadelphia, Pennsylvania. Those skilled in the art recognize that curtain or screen material manufactured by others may be found suitable. A feature of the preferred curtain of screen material is that it is flexible in one direction, lengthwise of the hopper, but is practically inflexible in the other direction, transversely of the hopper. As shown in FIGS. 1 and 3, the curtains or screens 43, 45 pass over intermediary rollers 45, 47 that may be suitable mounted (not shown) to the supports 31, 33.

The free ends of the curtains or screens 43, 45 are disposed in spaced-apart relation just far enough to admit of a hood 51 being positioned therebetween. As shown in FIG. 3, the hood 51 is comprised of two pivotable sections 51*a*, 51*b* that are pivotally mounted, as at 53, to a coke guide support 55, mounted to a coke guide carriage 57. The coke guide carriage 57 is provided with wheel and axle assemblies (trucks) 59 that move on rails 61 supported on structure 63, about as shown in FIG. 3.

In FIG. 3, a conventional coke guide 65 is shown in position to guide hot coke when it is pushed from an oven chamber of the battery 23. The coke guide 65 is, of course, cooperative with the hood 51 so that no fumes or particulate matter can escape to the ambient atmosphere while hot coke is being pushed through the coke guide 65 and is passing through the hood 51 into the hopper 25.

Supporting the hopper end walls 67, 69 and the longitudinal side wall 71, the one located further from the coke oven battery 23, there is a conduit 73. The portions of the conduit 73 on the end walls 67, 69 of the hopper 25 are in fluid communication with the interior of the hopper 25 through a plurality of ports (not shown) in the end walls 67, 69; and gases, arising from hot coke that gravitates into the hopper 25, flow into the end portions of the conduit 73, as suggested by the arrows A and B in FIG. 2.

It will be noted from FIG. 2 that the conduit 73 along the longitudinal wall 71, and the end portion of the conduit along end wall 67, merge to form an end portion 75 having a circular cross section, as shown in FIG. 4. The end portion 75 is surrounded by a cover 77, shaped about as shown in FIG. 4.

Extending leftward from the cover 77 (FIG. 2) is a conduit 79 that carries fumes and particulate matter, flowing in conduit 73, toward a gas cleaning apparatus on an adjacent car (not shown).

As will be noted in FIGS. 1 and 3, the longitudinal side wall 71 is provided with two hinged portions 81, 83 that are pivotally mounted, as at 85, to swing out when the hopper is tilted in the manner described hereinafter, to discharge the quenched coke from the hopper 25.

Within the hopper 25 there is an articulated coke receiving bed 87, comprising two sections 87*a*, 87*b* that are comprised of a flat bottom 89*a*, 89*b*, end walls 91*a*, 91*b*, and, for each section 87*a*, 87*b*, a longitudinal side 93*a*, 93*b* that is disposed near the coke oven battery 23.

The movable bed sections 87*a*, 87*b* are each provided with a pair of rollers 95 at one end adjacent the intersection of the end wall 91*a*, 91*b* with the bottom 89*a*, 89*b*. The other end of each movable bed section 87*a*, 87*b* is hinge-connected, as at 97, to a vaulted plate structure 99 that extends transversely of the hopper 25. The vaulted plate structure serves to protect the hinge connections 97 from damage by hot coke as it gravitates into the hopper 25.

Figure 8:
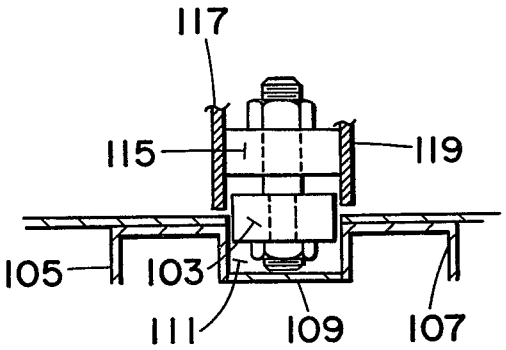
FIG. 8 is a view along line VIII—VIII of FIGS. 6 and 7.
Figure 7:
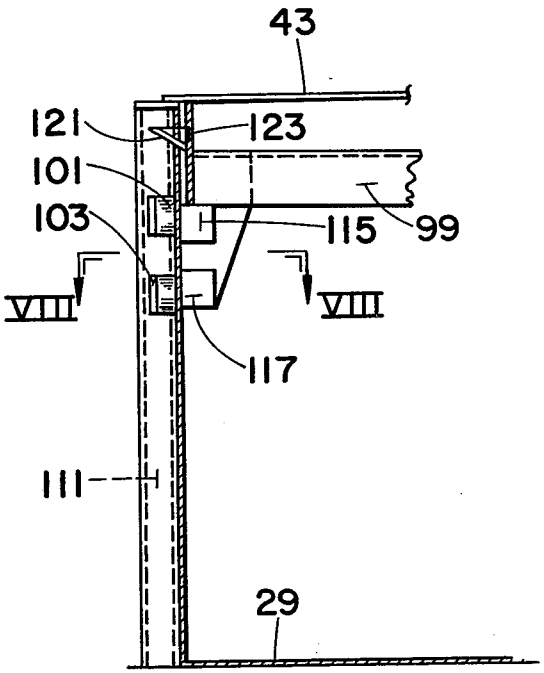
FIG. 7 is a view along line VII—VII of FIG. 6.
Figure 6:
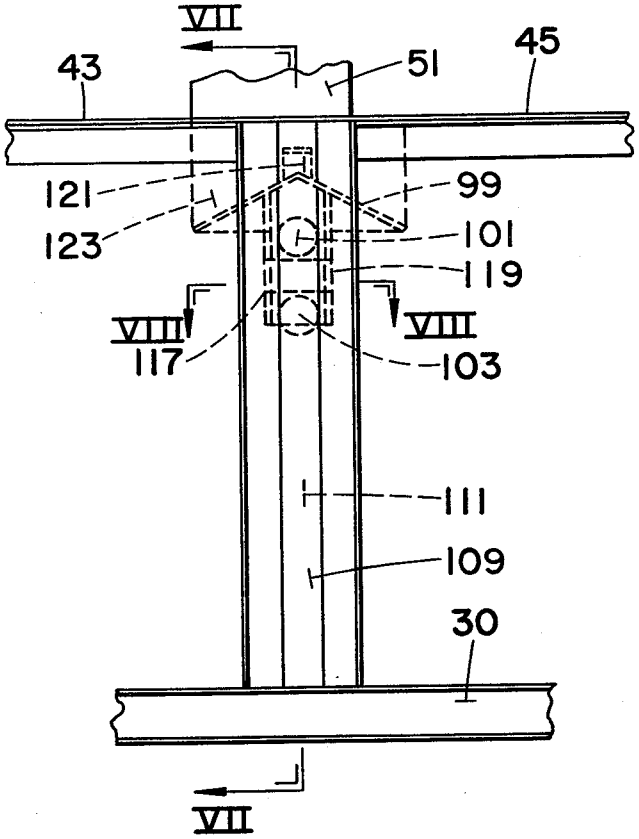
FIG. 6 is a view along line VI—VI of FIG. 2.

The vaulted plate structure 99 is provided with a pair of vertically arranged rollers 101, 103 at each end that are disposed between a pair of channels 105, 107 forming with a cover plate 109 a guideway 111 for the rollers 101, 103, as shown in FIG. 8. The rollers 101, 103 are suitably supported, as shown in FIG. 8, in blocks 115 welded, or otherwise suitably connected to plate brackets 117, 119 secured to the vaulted plate structure 99.

Extending outwardly from the peak of the vaulted plate structure 99 on both ends thereof, is an upwardly sloping deflector 121 that is disposed in the guideway 111 so that hot coke, when it falls into the hopper 25, does not enter and fill up and clog the guideway 111; also serving as it does to protect the rollers 101, 103 from the hot coke. A vertical cover plate 123 also is mounted to the end of the vaulted plate structure 99.

Figure 5:
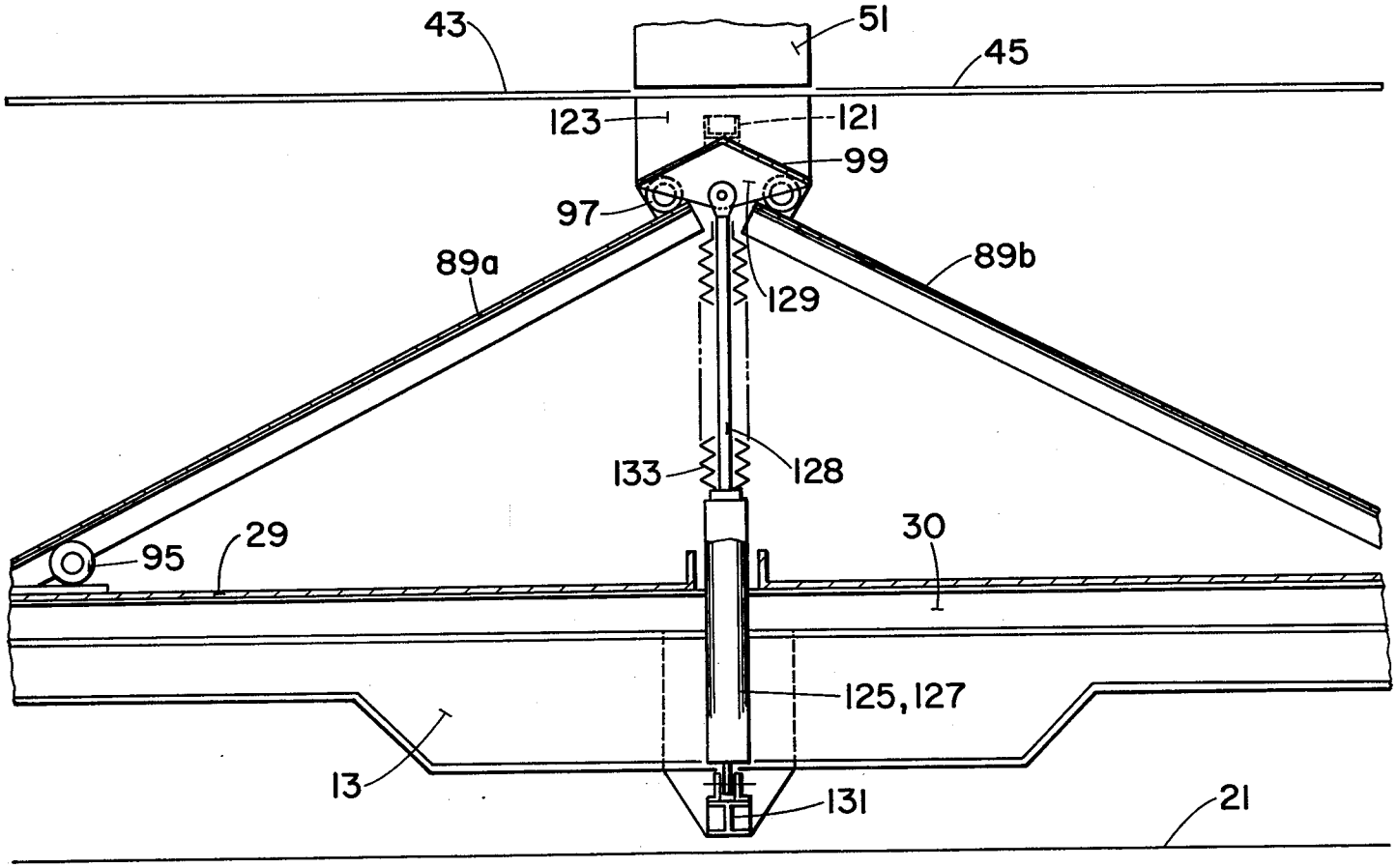
FIG. 5 is a view along line V—V of FIG. 2.

As shown in FIG. 5, the vaulted plate structure 99 is movable vertically by means of fluid-acting cylinder-piston assemblies 125, 127 (see FIGS. 1 and 3). The piston-rod portion 128 of each assembly is pivotally connected in a suitable manner to a plate bracket 129 forming a part of the vaulted plate structure 99. The opposite end of the cylinder portion of each assembly 125, 127 is pivotally mounted to a support 131 connected to the movable frame 30 of the hopper 25. To avoid contamination of the piston rod portion 128 by the falling hot coke, each piston rod portion 128 is surrounded by a suitable bellows 133.

Before coke is pushed from a coke oven chamber, the hopper 25 is spotted opposite the chamber of the coke oven battery 23; the coke guide 65 is moved into position after the doors have been removed from the oven chamber. Then, the hood 51 is actuated to cover the coke guide and to fit closely to the top of the hopper 25, as shown in FIG. 3. The screens or curtains 43, 45 are stretched out from the cylinders 39, 41 to cover the top of the hopper 25, and the equipment on the gas cleaning car, not shown, is activated to produce a slight vacuum or suction in the conduits 73, 79, and in the hopper itself.

The movable bed sections 89*a*, 89*b*, if not already in the raised position, are raised from a horizontal position to a raised position, as shown in FIGS. 1 and 5, by actuating the cylinder-piston assemblies 125, 127. It is to be understood that the movable bed sections 89*a*, 89*b* may be moved to any position intermediate the horizontal position and the elevated position shown in FIGS. 1 and 5. In another application, the bed sections 89*a*, 89*b* may actually be fixed in some elevated position and may not be movable at all if preferred.

During the pushing sequence, while hot coke is gravitating into the hopper, the movable bed sections are lowered to the horizontal position by retracting the piston-rod portions into their respective cylinders. By lowering the bed sections as coke is falling into the hopper, a more uniform depth of coke is achieved in the hopper. The vaulted structure 99 is shown in the lowered position at 99*a*.

After all of the hot coke is received by the hopper, the hood is raised, the coke guide is retracted and the curtains or screens are stretched so as to cover the opening through which the hot coke entered the hopper.

The quencher car is then moved to a quenching station and the hot coke is quenched. Thereafter, the hopper is moved to a position alongside a conventional coke wharf 135. The hopper is then pivoted about the pivot pins 27 by actuating a pair of cylinder-piston assemblies 137, 139 at the ends of the hopper. The cylinder-piston assemblies 137, 139 are pivotally connected to the main frame 13, and the piston rod portion of each assembly is pivotally connected to the end walls of the hopper.

At the coke wharf, the cylinder-piston assemblies 137, 139 are actuated to tilt the hopper about the pivot pins 27, from the vertical, upright position, shown in solid outline in FIG. 3, to the position shown in phantom lines in FIG. 3. As the hopper tilts, the pivotable side plates 81, 83 pivot about the hinges 85 and open discharge ports in the hopper, as shown in FIG. 3.

While the hopper is tilting, the conduit 75 (shown in FIG. 4) moves from the position shown in solid lines to the position shown at 75*a*. It will be noted that the coke in the hopper is quenched and that no great amount of fumes and dust arise from it while the hopper is being tilted. Yet, there is a suction in conduit 79 so that whenever fumes and dust are present, are drawn into conduit 79, regardless of the attitude of the hopper.

The quenched coke then discharges from the hopper onto the coke wharf. After the coke has been discharged completely, the hopper is returned to the vertical, upright position and the hinged side plates return to the closed position; they become latched automatically when the hopper is upright. The movable bed sections can be raised to the upper position while the quencher car is enroute to the next oven to be pushed.

Thereafter, the hopper is ready to receive hot coke from another coke oven chamber.

From the foregoing description of one embodiment of the invention, those skilled in the art should recognize many important features and advantages of it, among which the following are particularly significant:

That the articulated movable bed, which moves downwardly as coke gravitates into the hopper, acts to spread the hot coke more uniformly in the quencher car hopper;

That, because the hot coke is more uniformly deposited in the quencher car hopper, the coke can be more uniformly quenched in a shorter period of time at the quenching station; and That, because the movable bed can be raised to various heights at the hinge connection, the quencher car is useful to receive coke pusher from conventional ovens about 13 feet tall, as well as from ovens about 20 feet tall.

Although the invention has been described herein with a certain degree of particularity it is understood that the present disclosure has been made only as an example and that the scope of the invention is defined by what is hereinafter claimed.

What is claimed is:

1. In a one-spot coke quencher car having a tiltable hopper including means for tilting said hopper, wherein hot coke pushed from a coke oven battery chamber is received, and an extendible and retractable covering over said hopper, the improvement in said hopper comprising:

a. a transversely articulated vertically movable bed disposed within said hopper; and b. means for raising and lowering said bed to and from an angular position with respect to a horizontal plane.

2. The invention of claim 1 wherein:

a. said means for raising and lowering said bed to and from said angular position includes a fluid-acting cylinder-piston assembly.

3. The invention of claim 1 wherein:

a. said movable bed comprises two sections, disposed within said hopper with each section having a bottom, and an end wall adjacent an end wall of said hopper and at least one side wall fixed to said bottom of said section.

4. The invention of claim 3 including:

a. hinge means connecting together said sections of said articulated movable bed.

5. In a one-spot coke quencher car having a tiltable hopper with a bottom wherein hot coke pushed from a coke oven battery chamber is received, and an extendible and retractable covering over said hopper, the improvement in said hopper comprising:

a. a transversely articulated vertically movable bed comprising two sections, disposed within said hopper with each of said sections having a bottom, and an end wall adjacent an end wall of said hopper and at least one side wall fixed to said bottom of said section;

b. hinge means connecting together said sections of said movable bed; and c. cylinder-piston means, connected to said movable bed sections, disposed for raising and lowering said bed to and from an angular position with respect to a horizontal plane.

6. The invention of claim 5 including:

a. roller means on said sections that coact with the bottom of said hopper.

7. The invention of claim 5 including:

a. means guiding said hinge means as each of said movable bed sections are raised and lowered vertically.

8. The invention of claim 8 including:

a. means shielding said hinge means against coke as it gravitates into said hopper.

9. The invention of claim 7 wherein:

a. said means guiding said hinge means includes a channelway on a longitudinal wall of said hopper.

10. The invention of claim 9 including:

a. means for preventing coke falling into said hopper from entering and clogging said channelway.

11. In a one-spot coke quencher car having a tiltable hopper with a bottom therein, wherein hot coke pushed from a coke oven battery chamber is received, and an extendible and retractable covering over said hopper, the improvement in said hopper comprising:

a. a transversely articulated vertically movable bed comprising two sections, disposed within said hopper with, each of said sections having a bottom, and an end wall adjacent an end wall of said hopper and at least one side wall fixed to said bottom of said section;

b. hinge means connecting together said sections of said movable bed;

c. cylinder-piston means, connected to said movable bed sections, disposed for raising and lowering said bed to and from an angular position with respect to a horizontal plane;

d. roller means on each of said sections that coact with said bottom of said hopper;

e. a channelway on a longitudinal wall of said hopper;

f. a roller that travels in said channel way mounted to said hinge means;

g. a shield means over said hinge means for preventing coke from contacting said hinge means; and h. means on said shield means for preventing coke from entering and clogging said channel way.

* * * * *